US005553724A

United States Patent [19]

Moher et al.

[11] Patent Number: 5,553,724

[45] Date of Patent: Sep. 10, 1996

[54] RACK FOR DISPLAYING TABLEWARE

[75] Inventors: Robert Moher, Oneida, N.Y.; Thomas J. Nook, Grand Haven, Mich.

[73] Assignee: Oneida Ltd., Oneida, N.Y.

[21] Appl. No.: 214,143

[22] Filed: Mar. 16, 1994

[51] Int. Cl.[6] ..... A47F 7/00

[52] U.S. Cl. ..... 211/70.7; 211/47; 211/150; 312/118; 312/321.5

[58] Field of Search ..... 312/138.1, 321.5, 312/118, 327, 328; 211/70.7, 134, 150, 47, 106, 99

[56] References Cited

U.S. PATENT DOCUMENTS

| | | | |
|---|---|---|---|
| 1,473,215 | 11/1923 | De Witt | 312/118 X |
| 3,249,392 | 5/1966 | Berman | 312/118 |
| 3,288,545 | 11/1966 | Benne | 312/327 X |
| 3,534,863 | 10/1970 | Howard | 211/47 |
| 3,570,679 | 3/1971 | Edson | 211/47 |
| 3,771,847 | 11/1973 | Aylworth | 312/321.5 X |
| 4,498,592 | 2/1985 | Colucci | 211/106 X |
| 5,172,969 | 12/1992 | Reuter et al. | 312/328 |

*Primary Examiner*—Robert W. Gibson, Jr.
*Attorney, Agent, or Firm*—Harris Beach & Wilcox

[57] ABSTRACT

An improved display rack for the commercial display of tableware comprising a back panel, having two side panels attached thereto, a plurality of full shelves in parallel relationship to one another, each abutting the back panel and side panels, at least one rotatably hinged front panel corresponding to each full shelf, each front panel positioned so that a bottom edge is aligned with a corresponding full shelf, a display pad detachably affixed to at least one front panel, at least one hinge rotatably affixing each front panel to the rack, and at least one retainer for retaining tableware on the front of the display pad for display thereof.

16 Claims, 9 Drawing Sheets

FIG.15
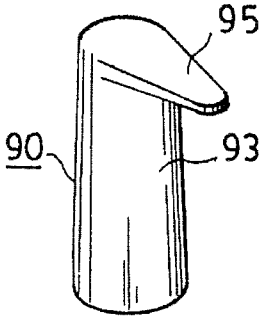
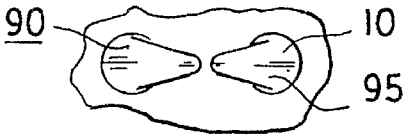
FIG. 16
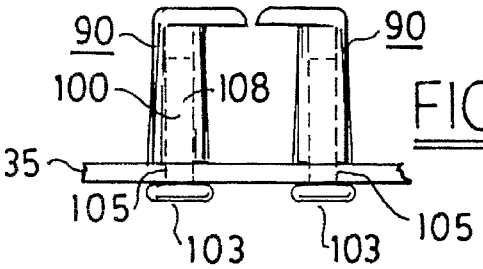
FIG.17
FIG. 18
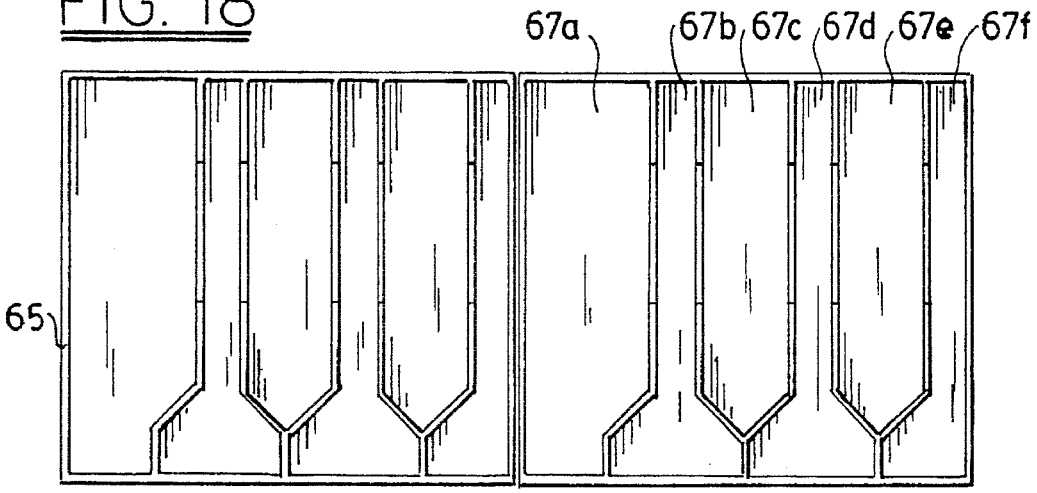
FIG.19
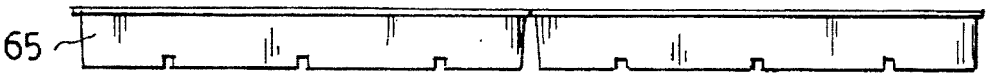
FIG.20
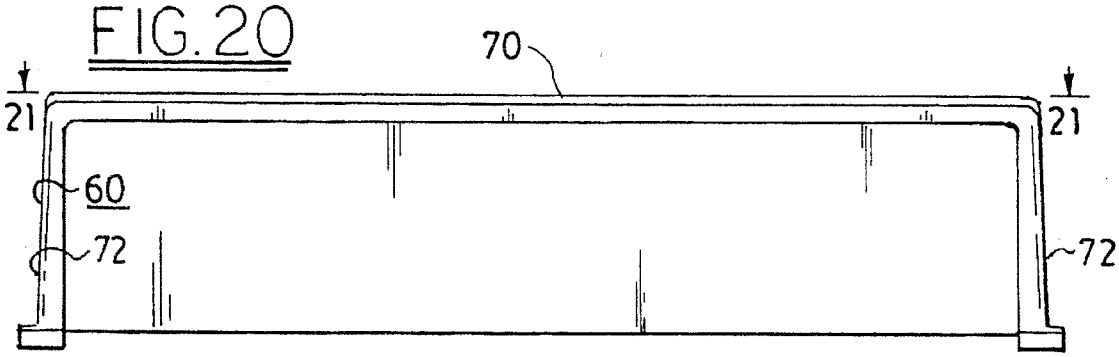

RACK FOR DISPLAYING TABLEWARE

BACKGROUND OF THE INVENTION

1. Field of the Invention

This invention relates to an improved rack for displaying tableware such as flatware and silverware and the like and, more particularly, to an improved rack for displaying tableware wherein the tableware is securely retained when the front panel is moved and yet is easily removable and where both boxed sets and individual open stock pieces are easily accessible.

2. Description of the Prior Art

Tableware display racks are used in stores such as department stores, kitchen specialty stores and the like in order to assist in the marketing of the tableware that is displayed thereon. While display of tableware can range from the most simple method of laying boxed sets on shelves, to the use of more elaborate stands or boxes, such as those disclosed in U.S. Pat. No. 3,175,694 to Reibold et al and U.S. Pat. No. 4,950,143 to Stanfield, it should be kept in mind that the presentation of tableware to the purchasing public can be an effective marketing tool. In designing a display rack, then, a number of considerations are of importance in addition to the mere presentation of tableware so that the designs are easily visible.

Starting first with the exterior of the rack, physical appearance is important. Higher price tableware, particularly silver and silver-plated tableware, can cost well over one hundred dollars per place setting. Flatware and hollowware although available at lower price ranges, can also run to similarly large expenditures. Thus both the large sections of the rack, such as the back, sides and the like, and the front display panels upon which the displayed tableware rests, should be attractive and elegant looking to complement the displayed tableware.

The appearance of the display pads - that is the top surface upon which the tableware on display is also of importance. The display pads generally consist of three parts. The first part is the flat surface against which the tableware is displayed. The second is a bottom valance against which the bottoms of the tableware rest when the pad is in its normal display position, which is at an angle of about fifteen degrees (15°) from the vertical axis. This is a grouping of one or more retainers each of which fits about the neck or stem of an individual or a group of equivalent tableware pieces. In the prior art generally the flat underlying surface was fabricated of some sort of durable material which was covered with fabric for a luxurious appearance. A separate valence, which could be of plastic or wood, was independently affixed to the underlying surface. However the display pad can be subject to rough usage at the hands of customers; in that case the fabric may wrinkle or be torn and gaps can appear between the flat surface and the valence. Any one or more of these conditions can greatly detract from the appearance of the display and, by association, from the value impression of the tableware displayed thereon.

In addition, it is desirable that as many sets of tableware be displayed on a single stand as is possible, without resorting to an unattractive cluttered effect. Many of the prior art racks for top-of-the-line tableware were able to accommodate only three rows with four display panels per row. The ability to display four rows on a rack allows more tableware to be displayed without the need of additional, and expensive, floor space being used.

Aside from aesthetic considerations, a number of practical details are also in need of attention. First, there are a number of different configuration of display pads that may be appropriately used. Thus, for example, table settings which generally comprise a dinner fork, a salad fork, a knife, a teaspoon and a soup spoon are appropriately displayed using five retaining members. Serving utensils may comprise a butter knife, sugar spoon, serving fork, slotted spoon, large spoon and ladle and thus require six retaining members. An informational insert may be desired as a substitute for one of the tableware display units. In addition, if the conventional mode of display grouping changes - as for example to a three piece basic set with a three pieced add on, different pad configurations may be desired. Different colored display pads may also be desired to comport with changing trends in decor. Thus it is desirable to have display pads that can be easily and inexpensively exchanged without requiring major changes to the balance of the display rack.

An additional practical consideration is the retention of the tableware on the display rack. Prospective purchasers often wish to remove individual items from the rack in order to test them for heft, balance, comfort in use and the like. Thus the retaining members need to be capable of easily releasing an individual item and also allowing it to be easily restored to its correct position. However, place settings of tableware in varying quantities, completer sets, promotional brochures, and the like are normally stored behind the display pads. Thus the display pads, which are normally integral with the front panels of the display rack, are constantly being subject to manipulations which may be rough or abrupt. Prior art display racks tended to favor customer accessibility over tableware retention so that the retainers did not firmly hold individual pieces of tableware if the front panel was moved forcefully into an up or down position. This led to misalignment of the tableware resulting in a rather sloppy appearance at best and complete disengagement of the tableware which might then fall on the ground at worst.

Turning finally to the interior of the display rack, it is desirable to present the sets and individual pieces available for immediate purchase to the customer in a clear and well organized manner. Thus it is preferred that each pattern be available behind the panel upon which it is displayed, and that place setting be clearly differentiated from serving pieces. This organization helps curtail lost sales due to prospective customers being unable to find the items desired, or excessive employee time spent in reorganizing collections of tableware that have been disordered by ineffective searching. It also limits the destruction of and damage to factory provided packaging which could eventually lead to the necessity for discounting merchandise due to the packaging appearance alone. Finally, it allows inventory and restocking to be accomplished with minimal effort.

It is also desirable to avoid extremes of tension on the turning mechanism that allows the front panels to be lifted, giving access to the storage area behind each panel. Too much tension and the panel will be difficult to manipulate; too little and it may close abruptly which could possibly result in injury and is, at the very least, disconcerting. With time and usage there is a possibility of the tension level changing and so a mode of simple readjustment is highly desirable.

In addition, it is desirable that the hinge allow the panel to be opened in such a way as to provide maximum merchandising space for the boxes and open stock products that are stored inside the display case.

SUMMARY OF THE INVENTION

It is therefore a primary object of the present invention to provide an improved display rack for tableware.

It is a further object of the present invention to provide an improved commercial display rack for tableware.

It is a yet another object of the present invention to provide an improved commercial display rack for tableware having detachable display panels.

It is a still another object of the present invention to provide an improved commercial display rack for tableware having unitarily fabricated display panels.

It is a still a further object of the present invention to provide an improved commercial display rack for tableware having tableware retaining members which will hold tableware firmly in place during opening and closing of the front panels.

It is a yet another object of the present invention to provide an improved commercial display rack for tableware having improved storage organization inside the rack.

It is a still another object of the present invention to provide an improved commercial display rack for tableware having adjustable tension hinges for hingably opening the front panels to allow access to the interior thereof.

It is yet another object of this invention to provide an improved commercial display rack for flatware having hinges which allow panel storage to use minimal space.

These and other objects of the present invention are attained by an improved display rack for the commercial display of tableware comprising a back panel, having two side panels attached thereto, a plurality of full shelves in parallel relationship to one another, each abutting the back panel and side panels, at least one rotatably hinged front panel corresponding to each full shelf, each front panel positioned so that a bottom edge is aligned with a corresponding full shelf, a display pad detachably affixed to at least one front panel, at least one hinge rotatably affixing each front panel to the rack, and at least one retainer for retaining tableware on the front of the display pad for display thereof.

BRIEF DESCRIPTION OF THE DRAWINGS

For a better understanding of these and other objects of the present invention, reference is made to the detailed description of the invention which is to be read in conjunction with the following drawings, wherein:

FIG. 15 is a perspective view of a single tableware retaining member of the instant invention.

FIG. 16 is a top view of a pair of retaining members of FIG. 15.

FIG. 17 is a front view of the retaining members of FIG. 16.

FIG. 18 is a top view of a pair of tableware trays of the instant invention.

FIG. 19 is a side view of the trays of FIG. 18.

FIG. 20 is a side view of the half shelf of the instant invention.

DETAILED DESCRIPTION OF THE INVENTION

Figure 1:
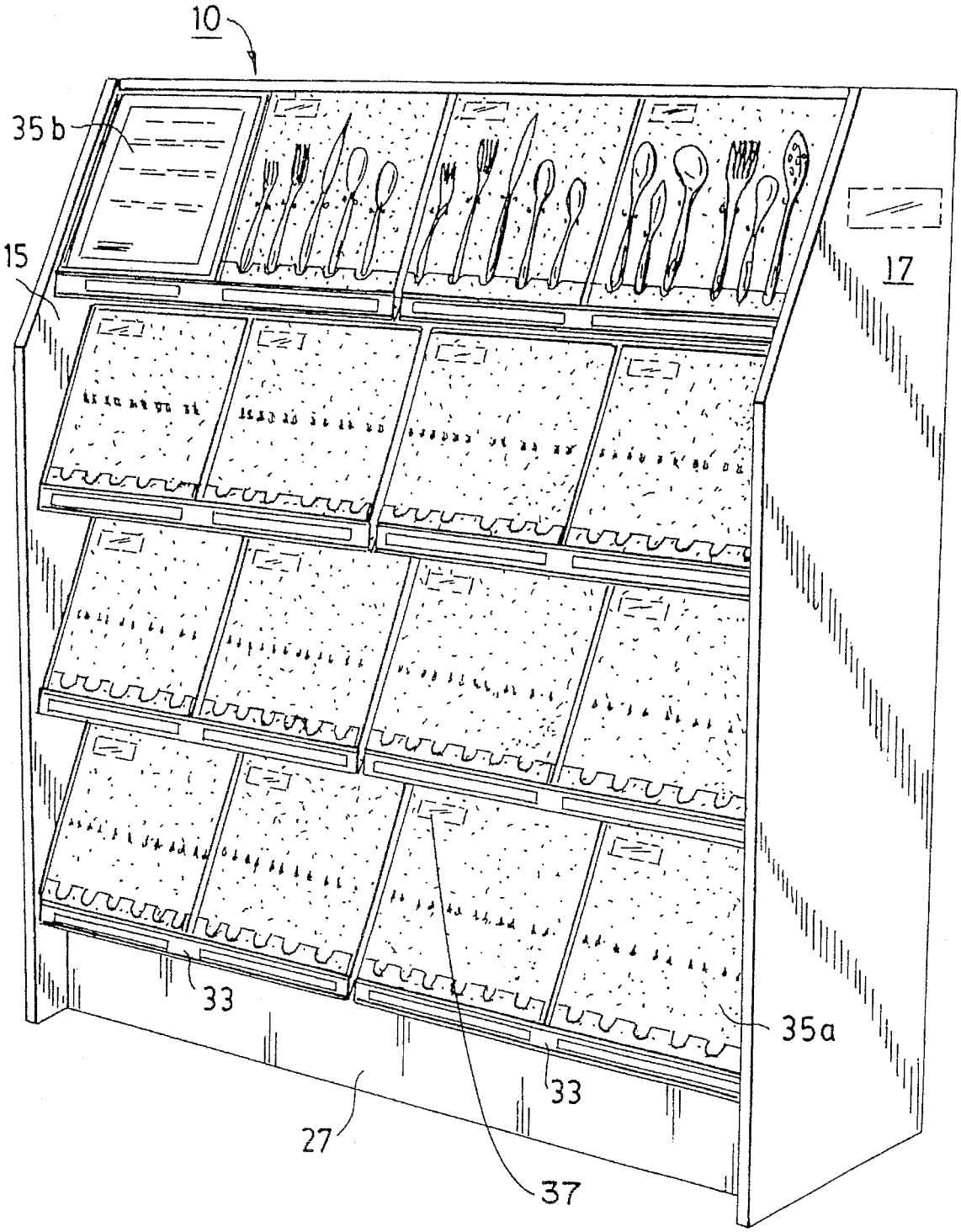
FIG. 1 is a perspective view of the display rack for tableware of the instant invention.
Figure 4:
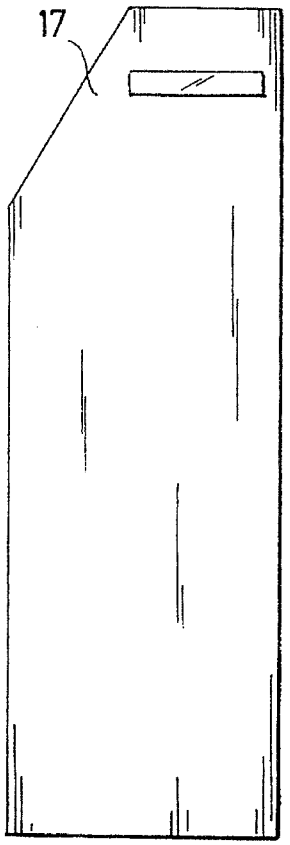
FIG. 4 is a left side view of the invention of FIG. 1.
Figure 2:
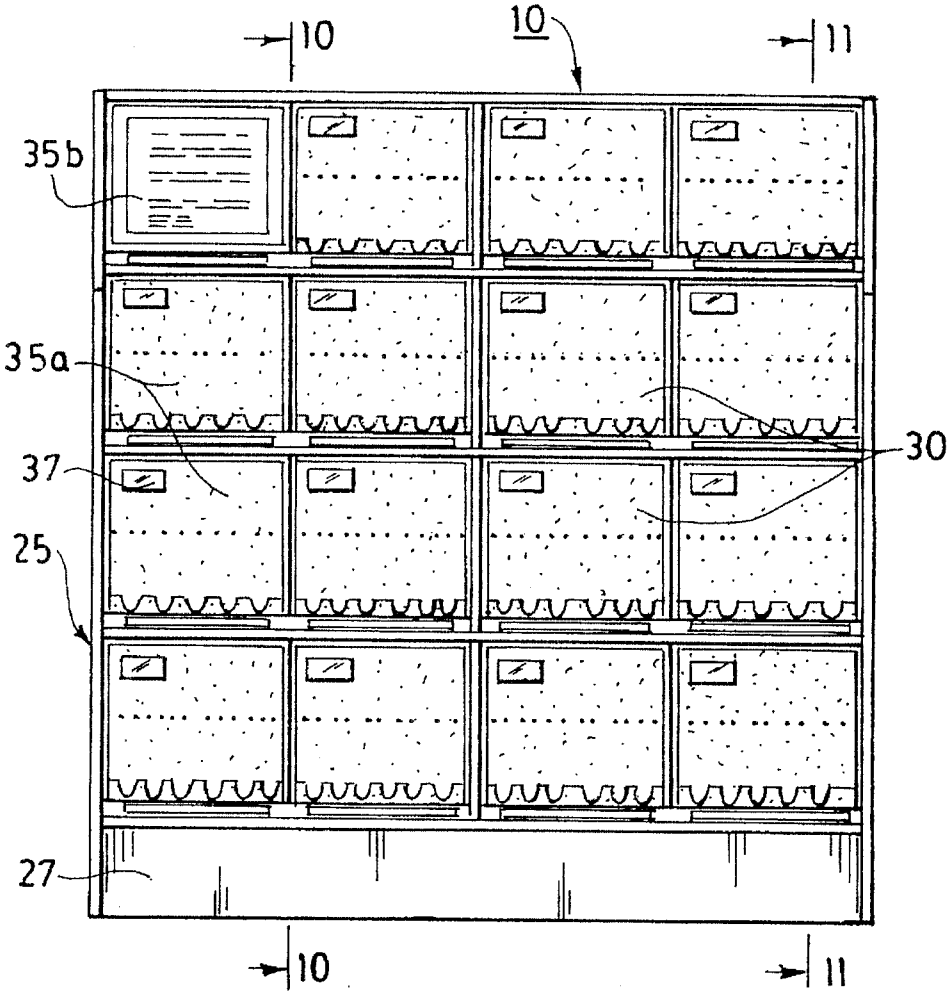
FIG. 2 is a front view of the invention of FIG. 1.
Figure 3:
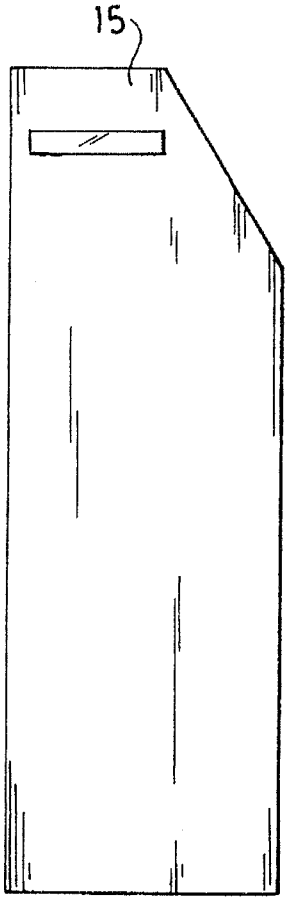
FIG. 3 is a right side view of the invention of FIG. 1.
Figure 5:
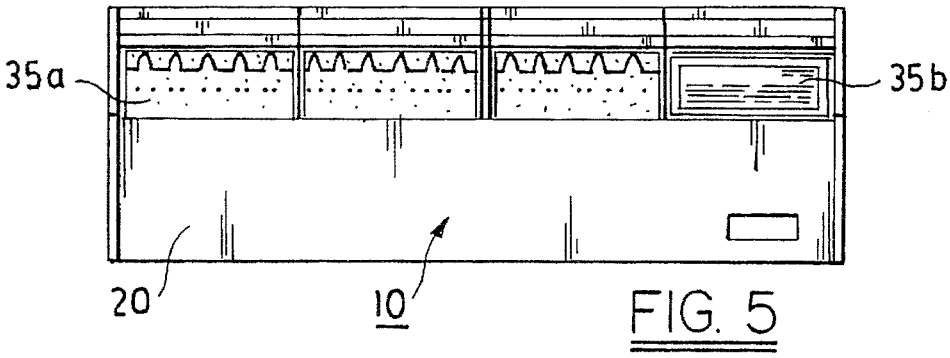
FIG. 5 is a top view of the invention of FIG. 1.
Figure 6:
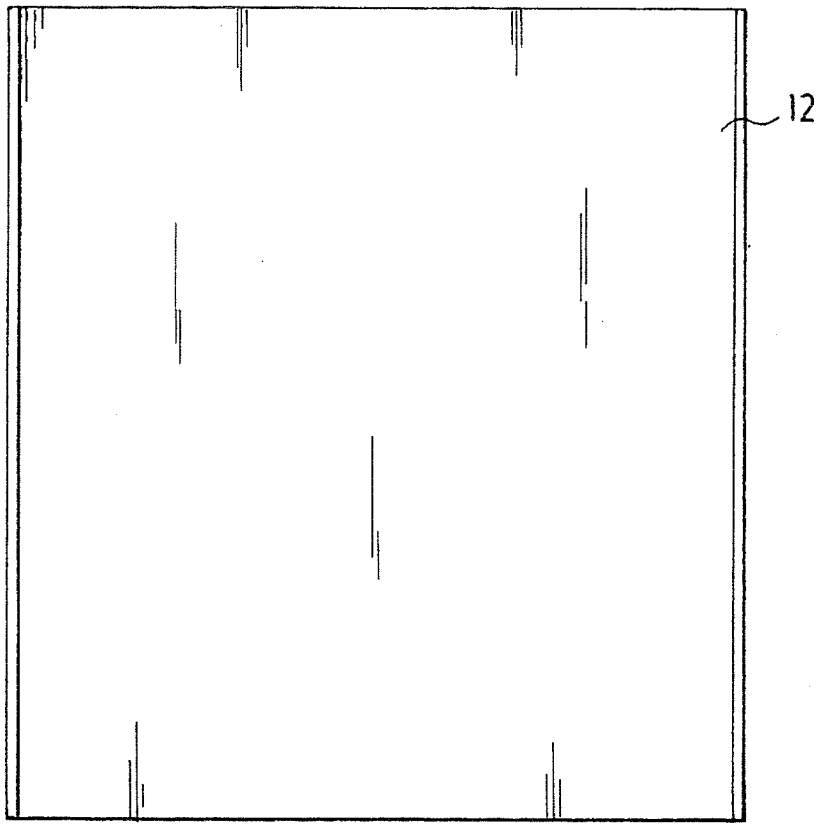
FIG. 6 is a back view of the invention of FIG. 1.
Figure 7:
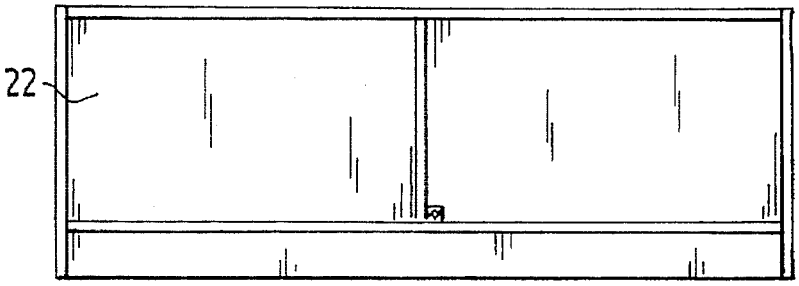
FIG. 7 is a bottom view of the invention of FIG. 1.

Turning now to the Drawing and particularly, FIGS. 1–7 thereof, there is seen a preferred embodiment of a display rack according to the instant invention, generally depicted as 10.

The external components of the display rack 10 comprise a back panel 12, right side panel 15, left side panel 17, top panel 20, bottom panel 22, and front 25. Except for side panels 15 and 17, each of which is cut to slant inward moving upwardly from front to back, beginning at a point approximately ¼ the length of the panel from the top, all the external faces appear to be substantially rectangular.

The front 25 is comprised in turn of a front bottom panel 27, above which are four display rows 30. Each display row 30 comprises two front panels 33, each front panel 33 being capable of retaining two display pads 35. The display pads may be of the type for displaying silverware 35*a* or one or more may of a type containing promotional text 35*b*. Those of the type for displaying silverware 35*a*, may have a plate 37 affixed thereto in order to provide minimal information such as the name of the pattern being displayed, or the name of the manufacturer.

Figure 8:
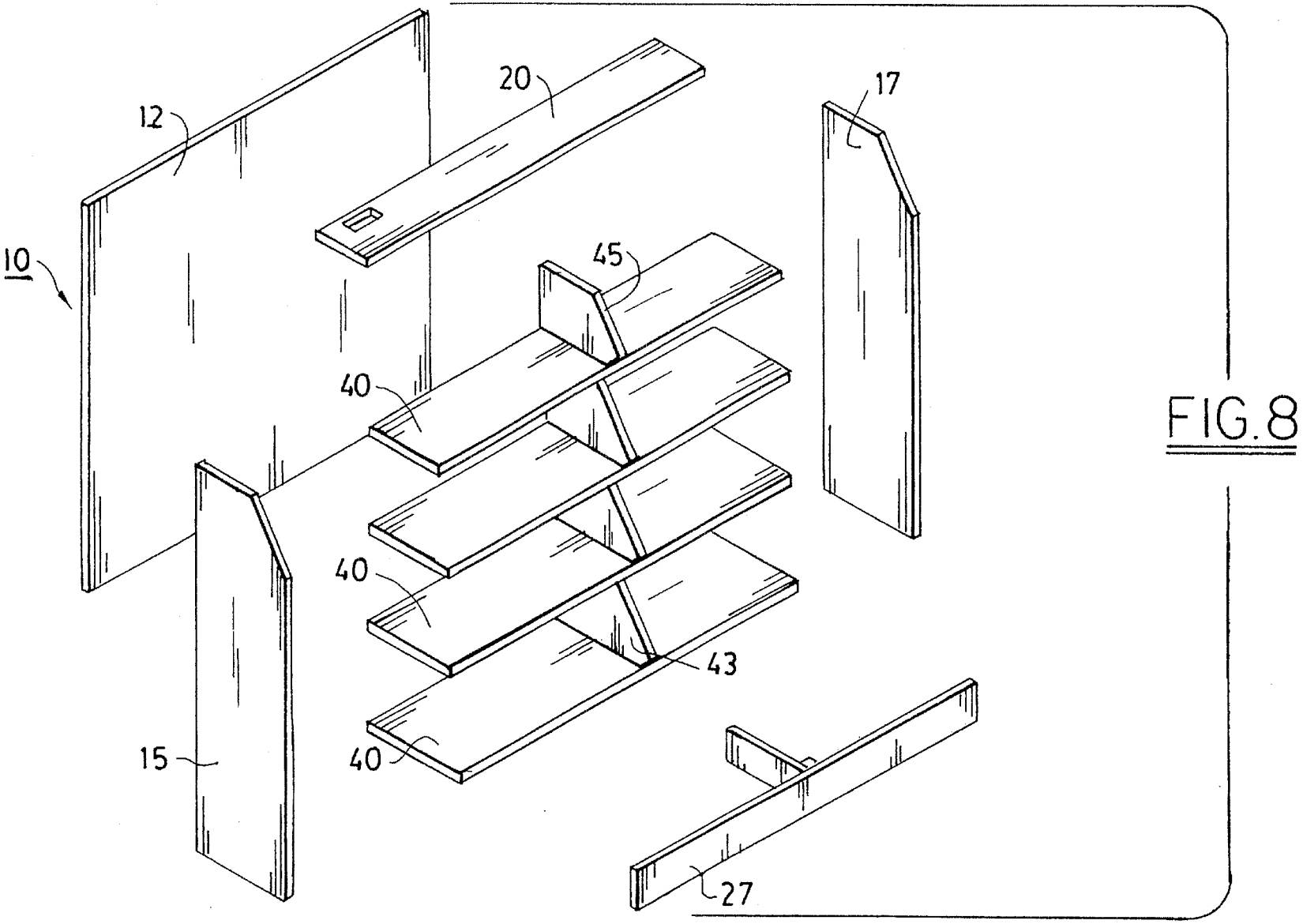
FIG. 8 is an exploded view of the basic parts of the instant invention, omitting the front panels.

The interior construction of the stand can be seen in FIG. 8. It is comprised of four essentially rectangular shelves 40 each separated from the one below by spacing panels 43. The uppermost of the shelves 40 is also separated from the top panel 20 by a spacing panel 43. It should be noted that the front edge 45 of each spacing panel 43 is slanted back at an angle of about 40° from the vertical. The front panels 33 slant back at this same angle when in the closed position.

Figure 10:
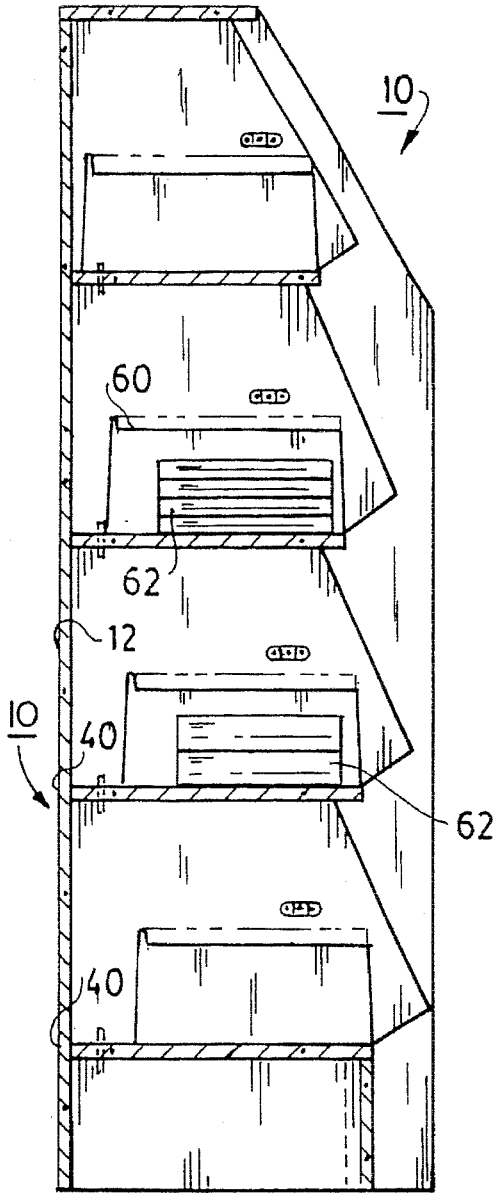
FIG. 10 is a cross sectional view of the instant invention taken along plane 10—10 of FIG. 2.
Figure 11:
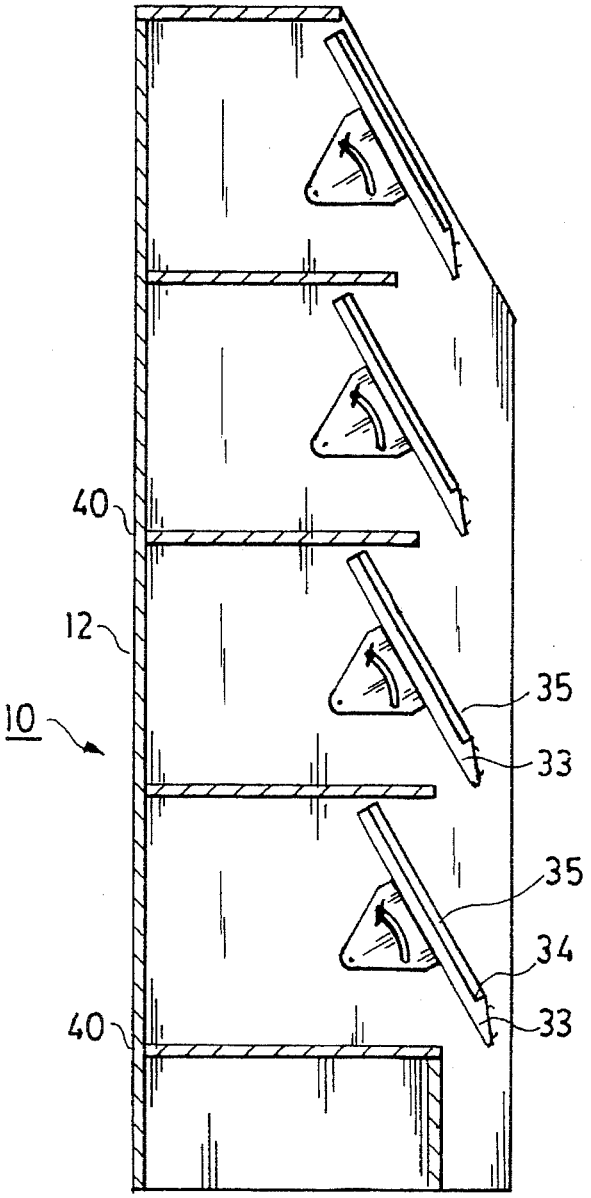
FIG. 11 is a cross sectional view of the instant invention taken along plane 11—11 of FIG. 2.

The front panels 33 rotate on hinges 50 as will be described hereinafter. The extremities of the rotation are the fully closed position, shown in FIG. 12 as 33*a* and the fully opened position, in which they rest horizontally, shown as 33*c*. When the front panels 33 are fully horizontal access is had to the interior shelves 40. The relationship of the half-shelves 60, shelves 40 and front panels 33 is better seen in the cut-away sections of FIGS. 10 and 11.

Figure 9:
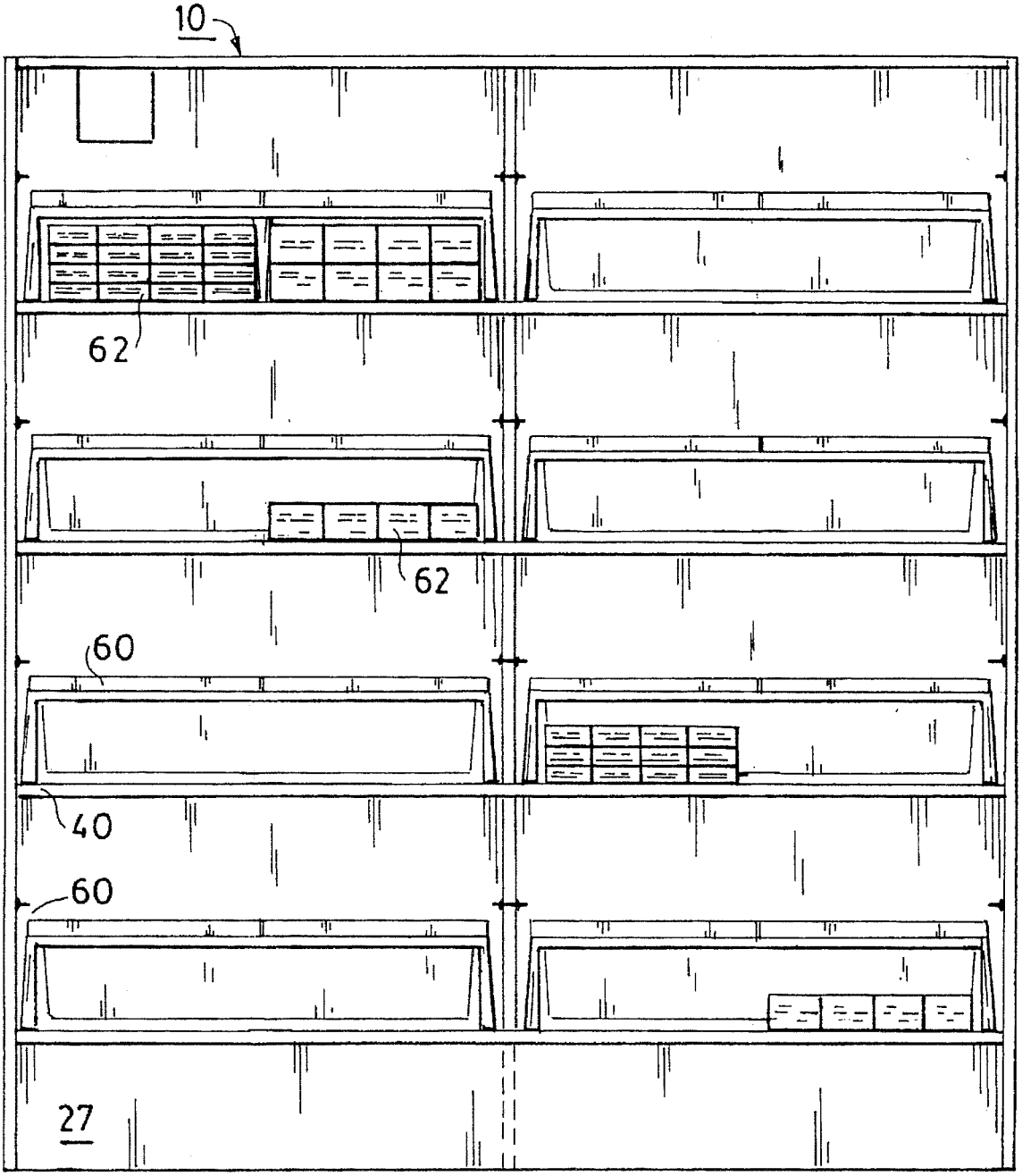
FIG. 9 is a front view of the invention of FIG. 2 with the front panels absent, showing the interior storage/areas.

Turning now to FIGS. 18–22, the interior storage and display section and the components thereof can be seen. The features of this section allows prospective purchasers easy access to and view of both boxed and unboxed (open stock) tableware that is available for purchase. Upon each shelf rests two half-shelves 60, as is seen in FIG. 9. Each half-shelf 60 is comprised of an essentially rectangular flat rest 70 having two essentially rectangular legs 72 72 depending perpendicularly from the shorter ends of the rectangle. The area beneath each half-shelf 60 is used for storage of and easy access to boxed sets of tableware 62 offered for sale, whether as individual or multiple place settings or as hostess sets or serving sets. Each half-shelf 60, in turn, accommodates two tableware trays 65 65 which can be used for the presentation of individual items of open stock tableware. Each tray 65 is divided into six compartments **67*a*–67*f* as shown in FIG. 18** so that it can accommodate a variety of sizes and shapes of tableware utensils for display and sale.

Some of the special features of the display pads 35 are seen in FIGS. 1, 13, and 15–17. Each display pad is 35 is removably attached to the front surface of the front panel 33 via minute hook and eye attachment strips, such as VELCRO pads 80 80 located on the back surface of the display pad, which co-act with VELCRO pads (not shown) on the front surface of the front panels. Other mechanisms for achieving easy detachability and replacement without the necessity of tools, such as snaps, magnets, hooks and the like as are well known in the art may alternatively be used. In addition to the means for attachment provided, each display pad 35 fits so that when vertical it rests on a lip 34 set in the front panel to accommodate the display panel. Thus the display pad 35 fits in a well in the front panel 33 so that it appears to be attractively integral thereto. The front panels are fabricated of formed styrene for lightweight durability.

Because of their detachability, the display pads 35 are easily exchangeable and can be moved about to accommodate changes in the tableware line, a need for different colors to harmonize with a changed color scheme, a change in the groupings of tableware being offered for sale, or to replace worn or damaged pads. Furthermore each individual display pad is formed of a unitary section of molded material which is flocked to present an elegant appearance without running the risk of tearing or wrinkling as can occur when fabric is used. Forming the display pad 35 as a unitary structure not only enhances the appearance thereof but, having an integral bottom rest 83, also avoids the problem of the bottom rest separating from the display pad, as it ordinarily may do after extended use. Such separation is not only unsightly but also allows the tableware to intrude into the gap and possibly fall therethrough.

Tableware is retained on the front of the display pads 35 by means of a co-acting pair of clips 90 90. Each clip 90 is comprised of a body 93 and a head 95. The body 93 is hollow, being in the shape of a tubular cylinder which is open at the bottom and tapers inwardly toward the top. The body 93 is fabricated of resilient material. Preferably it is fabricated of thermal plastic elastomer 67 shore A durometer plus colorant. In the preferred embodiment it is fabricated from MULTIFLEX TPE A 6221 plus colorant.

Perpendicular to the top of the body 93 is the head 95 which is cone shaped.

A pair of retainers 100 100 are fitted upward through corresponding holes 105 105 in the display pad 35 so that the nub 103 of each retainer 100, being too large to pass through hole 150, is held against the back surface of display pad 35. The stem 108 of each retainer 100 engages the hollow portion of each clip 90 via a friction fit so that the clips are held in a spaced apart relationship such that a tableware item or stack of tableware items can be inserted therebetween. The resiliency of each clip bodies 93 is sufficient to allow easy insertion and removal of tableware items between pairs thereof, yet there is sufficient rigidity so that, combined with the retention effects of the heads 95, the tableware items will be held firmly in place when the front panel is manipulated.

Figure 12:
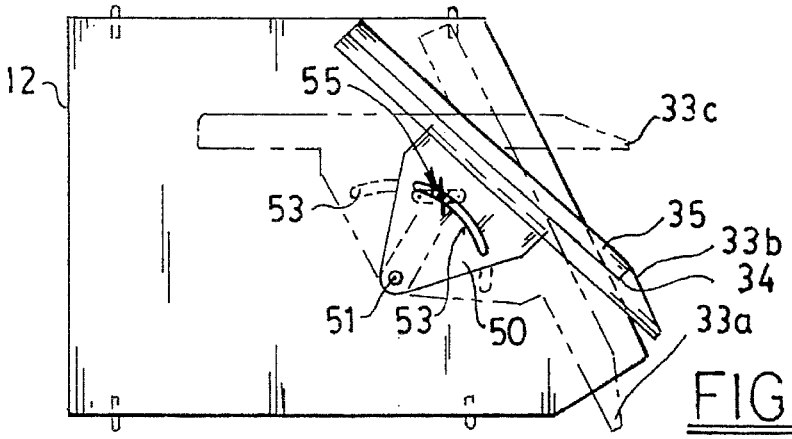
FIG. 12 is a detail cross sectional view of the instant invention, showing different possible front panel positions in phantom.
Figure 14:
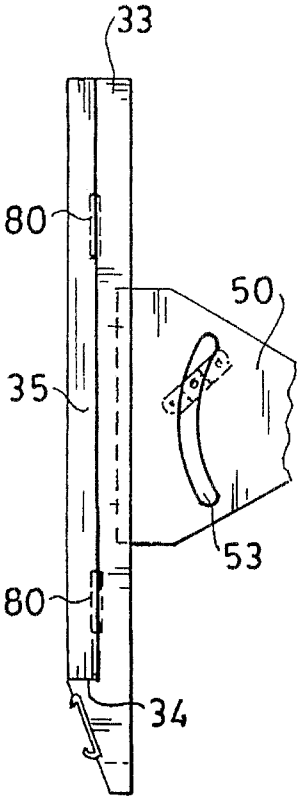
FIG. 14 is a detail side view of the front panel of thee instant invention, showing the display pad attached thereto.
Figure 13:
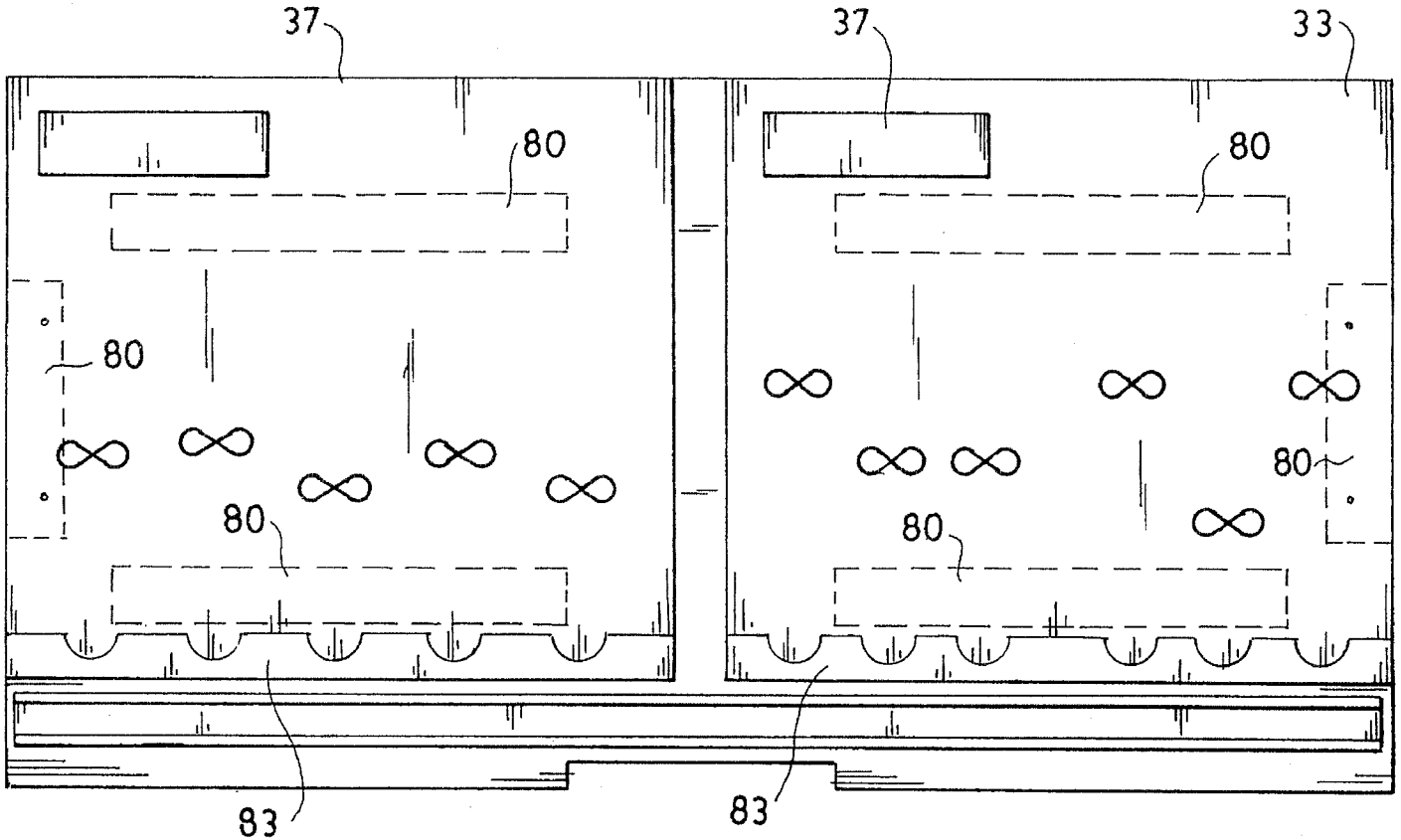
FIG. 13 is a detail front view of a paired set of display pads of the instant invention, showing their backside attachment strips in phantom.
Figure 21:
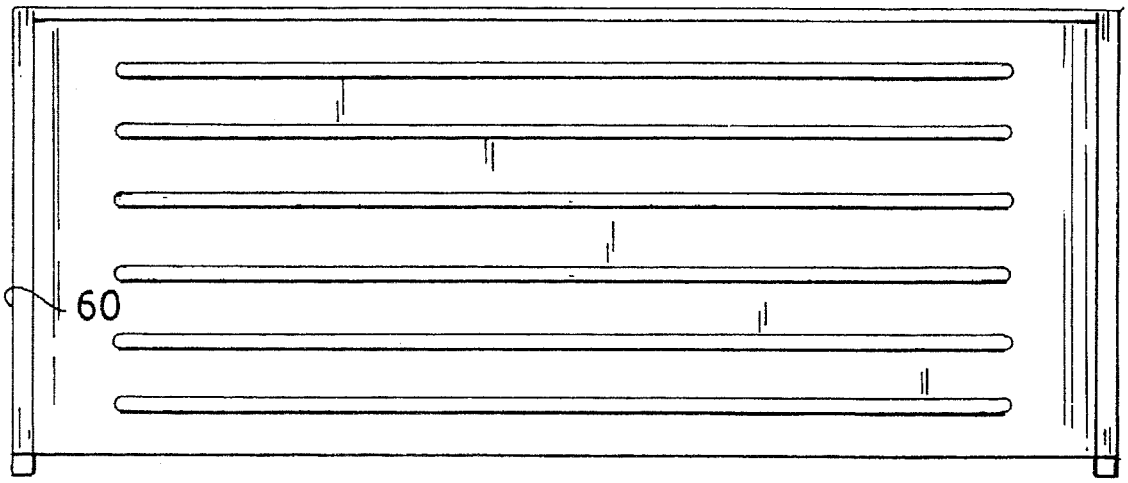
FIG. 21 is a top view of the shelf of FIG. 20 viewed along plane 21–21 of FIG. 20.
Figure 22:
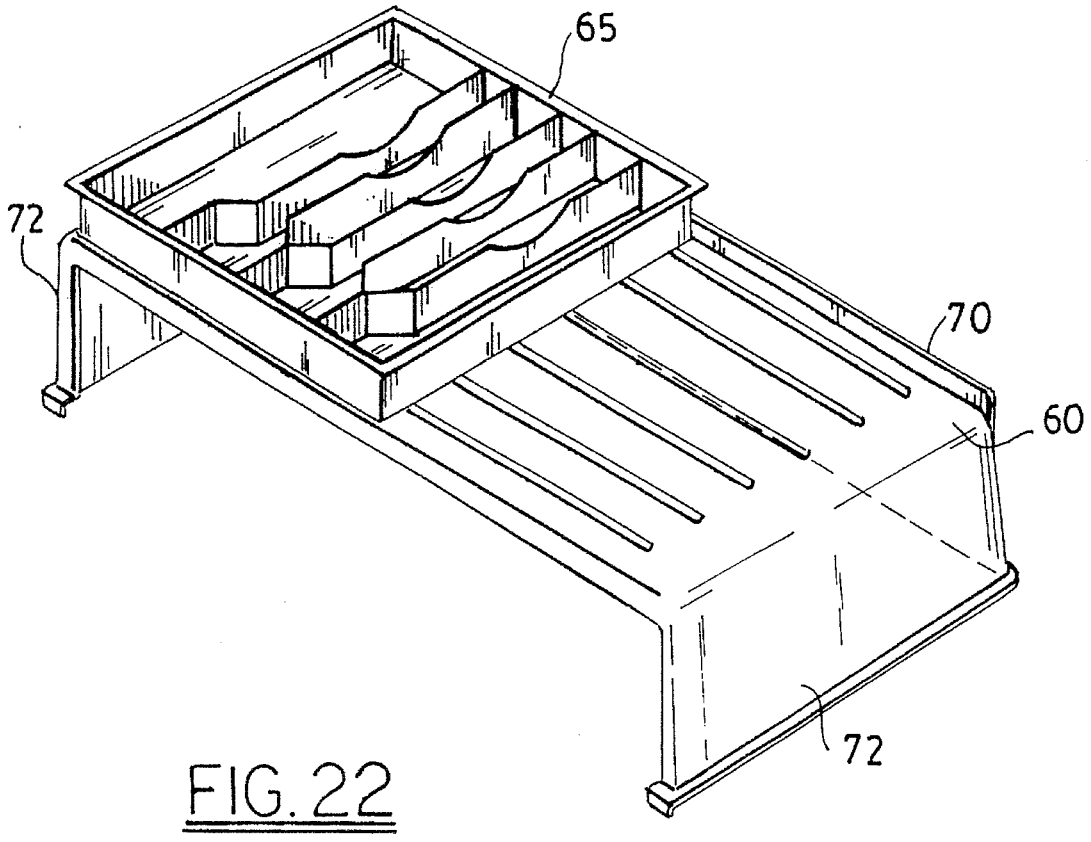
FIG. 22 is a perspective view of a half shelf and a single tray resting thereon.

FIGS. 12 and 14 show the operation of the hinge which allows the front panel 33 to rotate from fully closed position **33*a* to fully open position 33*c*. In the fully opened position, the front panel 33 uses a minimal amount of space inside of the display rack so that, in turn, the maximum amount of space remains for storage of the open stock and boxed merchandise. Centrally attached to the rear surface of the front panel 33, and essentially perpendicular thereto is pentangular shaped hinge 50 which is attached to a side panel via mated male/female parts at a pivot point (shown generally as 51) where either the hinge 50 or the side panel may contain the male part. The location of the pivot point 51 together with the pentangular shape of the hinge 50 allows the front panel 33 to retract into position when open so that is uses minimal storage space, thus maximizing the merchandisable space for open stock and product boxes. On the hinge is a thin semicircular cutout 53 in which rides adjustable pin 55 which is also seated in the side panel. Turning the adjustable pin 55 will, depending upon the direction in which it is turned, tighten or loosen the tension on the hinge 50. This clutch mechanism controls the rotation of the hinge, and hence the front panel 33, so as to control the amount of fall of the front panel 33**.

While this invention has been explained with reference to the structure disclosed herein, it is not confined to the details set forth and this application is intended to cover any modifications and changes as may come within the scope of the following claims:

What is claimed is:

1. An improved display rack for the commercial display of tableware comprising:

a back panel;

two side panels attached to said back panel;

a plurality of full shelves in parallel relationship to one another, each abutting said back panel and side panels;

at least one rotatably hinged front panel corresponding to each full shelf, each said at least one front panel positioned so that a bottom edge of said at least one front panel is aligned with a corresponding full shelf;

a display pad detachably affixed to said at least one front panel;

at least one hinge means for rotatably affixing each said front panel to the rack; and at least one retaining means for retaining tableware on a front of said display pad for display thereof.

2. The display rack according to claim 1 further comprising at least one half shelf corresponding to and situated above at least one full shelf.

3. The display rack according to claim 2 wherein said at least one half shelf removably rests upon said at least one full shelf.

4. The display rack according to claim 2 further comprising at least one divided tableware tray removably resting on said half shelf, said tray accommodating the storage of open stock tableware.

5. The display rack according to claim 1 wherein each full shelf has two rotatably hinged front panels corresponding thereto.

6. The display rack according to claim 1 wherein each said display pad rests on a lip of its corresponding front panel.

7. The display rack according to claim 1 wherein each retaining means comprises a pair of holders, each holder comprising a body portion and a head portion essentially perpendicular to said body portion, and wherein both head portions are centrally directed along a common axis, whereby tableware is retained between said body portions and under said head portions.

8. The display rack according to claim 7 wherein each said head portion is fabricated of resilient material.

9. The display rack according to claim 7 wherein each said body potion is shaped as an upwardly tapering cylinder and each said head portion tapers centrally.

10. The display rack according to claim 1 wherein said hinge means is adjustable to varying tension levels.

11. The display rack according to claim 1 wherein said plurality of full shelves comprises four full shelves.

12. The display rack according to claim 1 wherein said display pad is fabricated as a unitary display pad.

13. The display rack according to claim 12 wherein said unitarily fabricated display pad further includes an integral bottom rest.

14. The display rack according to claim 1 wherein each said display pad is detachably affixed to its corresponding front panel by means of strips containing minute eyes and hooks.

15. The display rack according to claim 1 wherein each front panel is associated with a corresponding display pad.

16. The display rack according to claim 1 in which said front panel has a closed position and an open position, and in which said front panel retracts into the display rack when said front panel is rotated into said open position.

* * * * *